US005676368A

United States Patent [19]

Wilson et al.

[11] Patent Number: 5,676,368

[45] Date of Patent: Oct. 14, 1997

[54] DOCUMENT DRIVE APPARATUS FOR DIRECTING A DOCUMENT AROUND A CORNER

[75] Inventors: Owen H. Wilson, Breslau; Jeff Crebolder, Kitchener, both of Canada

[73] Assignee: NCR Corporation, Dayton, Ohio

[21] Appl. No.: 821,898

[22] Filed: Mar. 21, 1997

Related U.S. Application Data

[63] Continuation of Ser. No. 645,881, May 13, 1996, abandoned.

[51] Int. Cl.[6] ..... B65H 5/00

[52] U.S. Cl. ..... 271/225; 271/273; 271/275; 271/184

[58] Field of Search ..... 271/184–186, 271/225, 273, 274, 275

[56] References Cited

U.S. PATENT DOCUMENTS

| | | | |
|---|---|---|---|
| Re. 26,004 | 4/1966 | Hoffswell | 271/186 |
| 3,025,051 | 3/1962 | David et al. . | |
| 3,436,073 | 4/1969 | Christmas | 271/186 |
| 3,635,463 | 1/1972 | Stobb | 271/185 X |
| 3,667,752 | 6/1972 | Samczyk . | |
| 3,973,767 | 8/1976 | Kramer | 271/275 X |
| 4,010,883 | 3/1977 | Ritter . | |
| 4,034,845 | 7/1977 | Honegger | 271/185 X |
| 4,045,014 | 8/1977 | Karlsson | 271/274 X |
| 4,320,963 | 3/1982 | Satomi . | |
| 4,369,955 | 1/1983 | Hornbuckle . | |
| 4,659,073 | 4/1987 | Leonard . | |
| 4,822,018 | 4/1989 | Hain | 271/184 X |

FOREIGN PATENT DOCUMENTS

| | | | |
|---|---|---|---|
| 92543 | 4/1988 | Japan | 271/273 |

*Primary Examiner*—Boris Milef
*Attorney, Agent, or Firm*—Michael Chan

[57] ABSTRACT

A document drive apparatus has an upstream end, a downstream end, and a document feeding line defined between the ends. The apparatus directs a document around a corner. The apparatus includes a drive drum having a central axis and rotatably mounted on a base member for rotation about its central axis. An endless drive belt is disposed on a pivot support and first and second arm members having one end thereof connected to the pivot support. The belt and the drum cooperate to define at least a portion of the feeding line defined between the upstream and downstream ends. At least one of the first and second arm members is pivotable about its end connected to the pivot support towards and away from the drum such that (i) a certain amount of the belt presses against the drive drum when the arm member is pivoted towards the drum to enable the document to be directed around the corner, and (ii) less than the certain amount of the belt presses against the drum when the arm member is pivoted away from the drum to enable a jammed document to be more easily removed from the document feeding line. The first and second arm members form an L-shape about the pivot support when the one arm is pivoted towards the drum. A snap mechanism holds an arm member in a locked position when the arm member is pivoted towards the drum. The snap mechanism is operable to allow the arm member to be pivoted about the pivot support away from the locked position to an unlocked position away from the drum.

8 Claims, 6 Drawing Sheets

DOCUMENT DRIVE APPARATUS FOR DIRECTING A DOCUMENT AROUND A CORNER

This is a continuation of application Ser. No. 08/645,881 filed on May 13, 1996 now abandoned.

BACKGROUND OF THE INVENTION

The present invention relates to document drive apparatus, and is particularly directed to a document drive apparatus which directs a document around a corner.

Many different types of document drive apparatus are known. One type of document drive apparatus includes an endless belt and a drivable drive drum which, when driven, cooperates with the belt to move and guide a document around a corner. Typically, the drum has an endless outer circumferential surface which contacts an endless outer major side surface of the belt. The area of contact between the surfaces define at least a portion of a document feed line and, in particular, that portion of the document feed line which extends around the corner. When the drum is driven and the leading edge of a document moves into the area of contact between the surfaces, the document is moved and guided along that portion of the document feed line around the corner.

From time to time, a document may become jammed in that portion of the document feed line defined by the area of contact between the outer circumferential surface of the drum and the outer major side surface of the belt. If a document jam occurs, the jammed document needs to be removed from the document feed line. During removal of the jammed document, it is desirable to be able to easily remove the document and to not tear the document while the document is being removed.

SUMMARY OF THE INVENTION

In accordance with the present invention, an apparatus is provided for directing a document having leading and trailing edges around a portion of an outer circumferential surface of a drive drum having an upstream end, a downstream end, and a document feeding line defined between the ends and for enabling a jammed document to be easily removed from the document feeding line. The apparatus comprises a pivot support adjacent the outer circumferential surface of the drive drum. The apparatus also comprises a first arm member having one end thereof connected to the pivot support, and a second arm member having one end thereof connected to the pivot support. The apparatus further comprises an endless drive belt disposed on the pivot support and the first and second arm members. The endless drive belt and the outer circumferential surface of the drive drum cooperate to define at least a portion of the document feeding line defined between the upstream and downstream ends of the drive drum. At least one of the first and second arm members is pivotable about its end connected to the pivot support towards and away from the outer circumferential surface of the drive drum such that (i) a certain amount of the outer endless major side surface of the endless drive belt presses against the outer circumferential surface when the at least one arm member is pivoted towards the outer circumferential surface of the drive drum to enable the document to be directed around the portion of the outer circumferential surface of the drive drum, and (ii) less than the certain amount of the outer endless major side surface of the endless drive belt presses against the outer circumferential surface of the drive drum when the at least one arm member is pivoted away from the outer circumferential surface of the drive drum to enable a jammed document to be easily removed from the document feeding line.

Preferably, each of the first and second arm members is pivotable towards and away from the outer circumferential surface of the drive drum. One of the arms includes surface means defining a notch-shaped area having a curvature which is complementary to the curvature of the outer circumferential surface of the drive drum. A first snap mechanism holds one arm member in a locked position when the one arm member is pivoted towards the outer circumferential surface of the drive drum. The first snap mechanism is operable to allow the one arm member to be pivoted about the pivot support away from the locked position to an unlocked position away from the outer circumferential surface of the drive drum. A second snap mechanism holds the other one arm member in a locked position when the other one arm member is pivoted towards the outer circumferential surface of the drive drum. The second snap mechanism is operable to allow the other one arm member to be pivoted about the pivot support away from the locked position to an unlocked position away from the outer circumferential surface of the drive drum.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILS OF THE INVENTION

Figure 1:
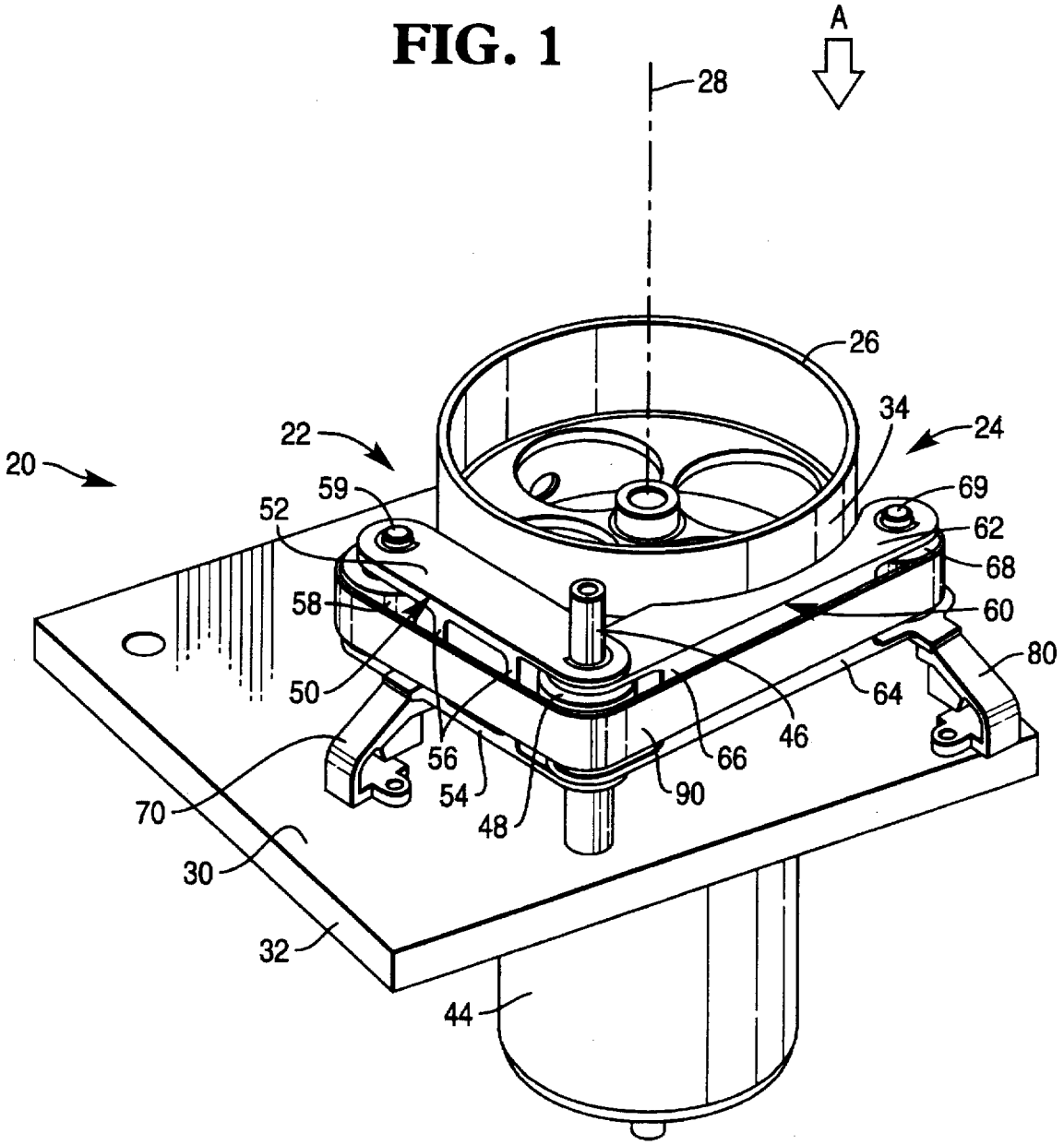
FIG. 1 is a perspective view of an apparatus constructed in accordance with the present invention.
Figure 2:
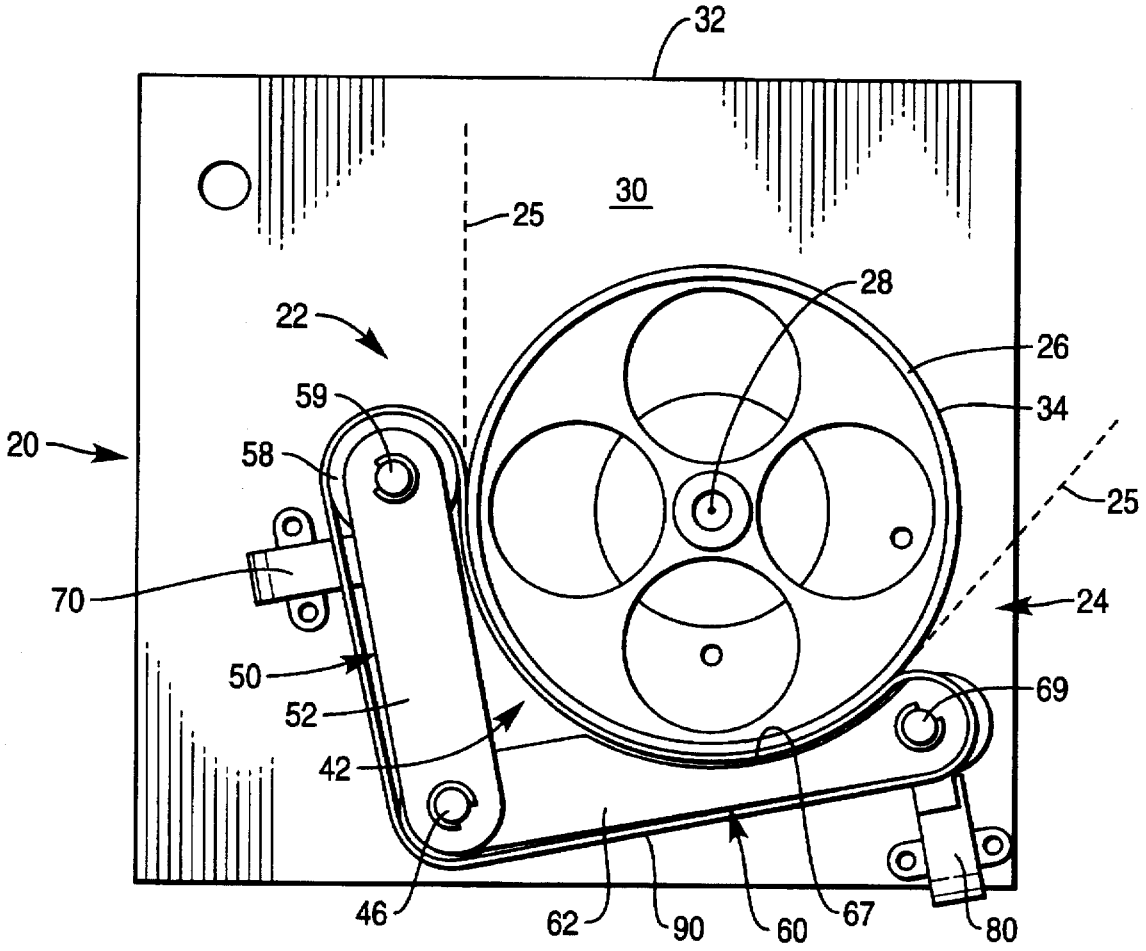
FIG. 2 is a view looking in the direction of arrow A in FIG. 1.

The present invention is directed to a document drive apparatus which moves and guides a document around a corner. The specific use and construction of the present invention may vary. By way of example as shown in FIGS. 1 and 2, a document drive apparatus 20 constructed in accordance with the present invention is embodied in a document processing system such as a bank check processing system.

The document drive apparatus 20 has an upstream end 22, a downstream end 24, and a document feeding line 25 (shown in dashed lines in FIG. 2) defined between the upstream end 22 and the downstream end 24. A drivable drive drum 26 has a central axis 28 and is rotatably mounted on a mounting surface 30 of a base member in the form of a base plate 32 for rotation about its central axis 28. The drive drum 26 has an outer circumferential surface 34 for engaging a document 36 (FIG. 3) having a leading edge 38 and a trailing edge 40 to move and guide the document 36 around a corner 42 (FIGS. 2 and 3) defined in part by the outer circumferential surface 34 of the drive drum 26. The output shaft (not shown) of an energizable motor 44 (FIG. 1) is operatively coupled with the drive drum 26. When energized, the output shaft of the motor 44 rotates in a direction to rotate the drive drum 26 about its central axis 28 in the counter-clockwise direction (as viewed in FIG. 2).

A pivot support in the form of a pivot post 46 is mounted on the mounting surface 30 of the plate member 32. The pivot post 46 is located adjacent the outer circumferential surface 34 of the drive drum 26. A pivot roller 48 (FIG. 1) is rotatably mounted on the pivot post 46 in a known manner.

A first arm assembly 50 includes a top plate portion 52 and a bottom plate portion 54 (FIG. 1) which is fixedly connected through an interconnecting portion 56 to the top plate portion 52. One end of the first arm assembly 50 is pivotally connected to the pivot post 46 in a known manner. More specifically, one end of the top plate portion 52 is pivotally connected to the pivot post 46 on one side of the pivot roller 48, and one end of the bottom plate portion 54 is pivotally connected to the pivot post 46 on the opposite side of the pivot roller 48. A first roller 58 is rotatably mounted on a first shaft 59 which is fixedly connected between the top plate portion 52 and the bottom plate portion 54 at the free end of the first arm assembly 50.

Similarly, a second arm assembly 60 includes a top plate portion 62 and a bottom plate portion 64 (FIG. 1) which is fixedly connected through an interconnecting portion 66 to the top plate portion 62. One end of the second arm assembly 60 is pivotally connected to the pivot support 46 in a known manner. More specifically, one end of the top plate portion 62 is pivotally connected to the pivot post 46 on one side of the pivot roller 48, and one end of the bottom plate portion 64 is pivotally connected to the pivot post 46 on the opposite side of the pivot roller 48. A second roller 68 is rotatably mounted on a second shaft 69 which is fixedly connected between the top plate portion 62 and the bottom plate portion 64 at the free end of the second arm assembly 60. The first and second arm assemblies 50, 60 form an L-shape about the pivot post 46 when both arm assemblies 50, 60 are pivoted towards the outer circumferential surface 34 of the drive drum 26 as shown in FIGS. 1 and 2. Each of the arm assemblies 50, 60 is in a locked position as shown in FIGS. 1 and 2.

An endless drive belt 90 is wrapped around the pivot roller 48 and the first and second rollers 58, 68, as shown in FIGS. 1 and 2. The outer endless major side surface of the belt 90 and the outer circumferential surface 34 of the drive drum 26 cooperate to define at least a portion of the document feeding line 25 defined between the upstream end 22 and the downstream end 24. More specifically, the belt 90 is deformed along an arcuate area of contact on the outer circumferential surface 34 of the drive drum 26 when the first and second arm assemblies 50, 60 are in locked positions shown in FIGS. 1 and 2.

That area of contact between the outer circumferential surface 34 and the outer endless major side surface of the belt 90 forms a portion of the document feeding line 25 defined between the upstream end 22 and the downstream end 24. The drive drum 26 rotates about its central axis 28 and the belt 90 moves around the pivot roller 48 and the first and second rollers 58, 68 such that belt pressure (pinch pressure) is developed between the rotating drive drum 26 and the moving endless drive belt 90. The second arm assembly 60 includes a surface which defines a notch-shaped area 67. The notch-shaped area 67 has a curvature which is complementary to the curvature of the outer circumferential surface 34 of the drive drum 26. The drive drum 26 is positioned within the notch-shaped area 67, as shown in FIG. 2.

Figure 3:
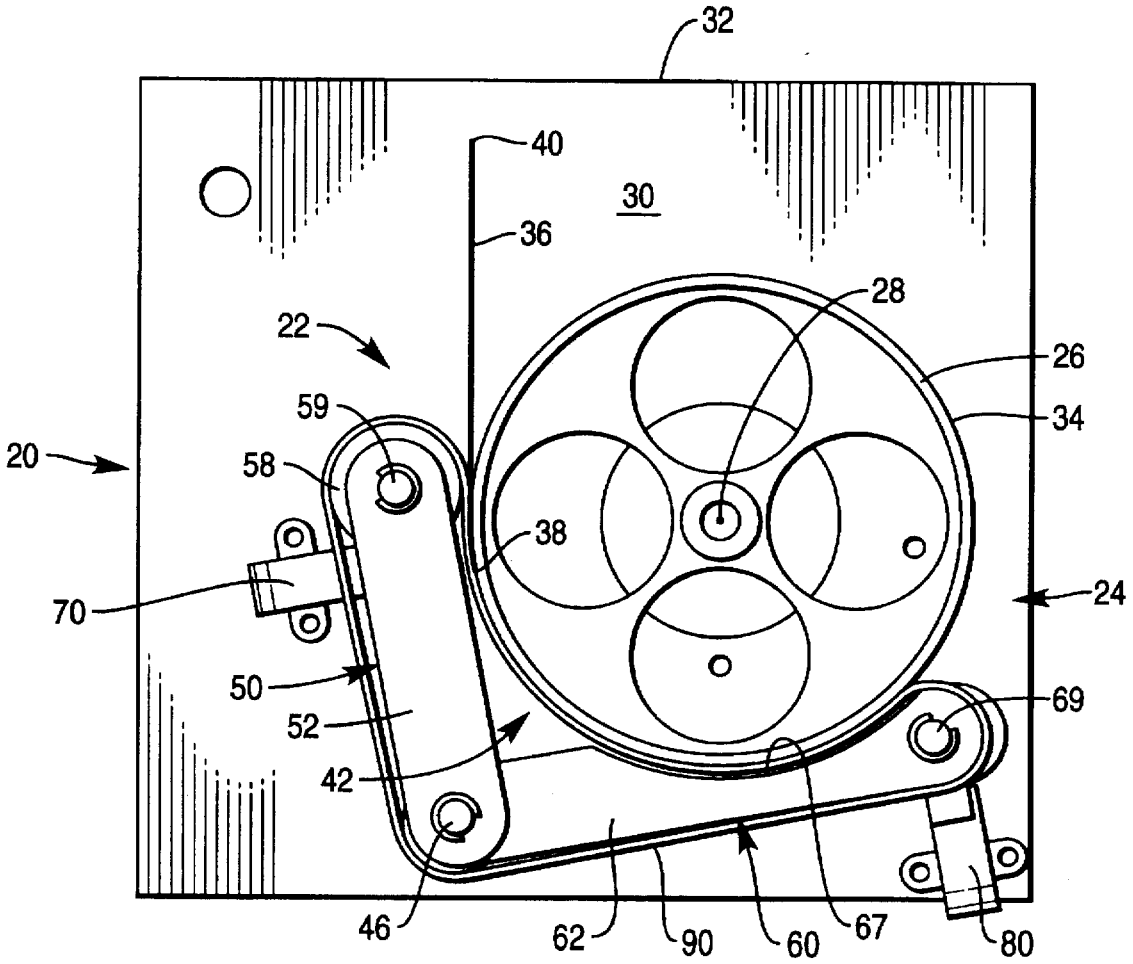
FIG. 3 is a view similar to FIG. 2 and showing a document located in a document feeding line.

When the drive drum 26 rotates counter-clockwise as shown in FIG. 3 and the leading edge 38 of the document 36 moves into that portion of the document feeding line 25 defined by the area of contact between the outer circumferential surface 34 and the outer endless major side surface of the belt 90, the pinch pressure is sufficient such that the document 36 is sandwiched between the outer circumferential surface 34 of the drum 26 and the outer endless major side surface of the belt 90. The rotation of the drive drum 26 and the movement of the belt 90 moves and guides the document 36 around the corner 42 defined by the drive drum 26 and the belt 90 from an initial position such as shown in FIG. 3 to an intermediate position such as shown in FIG. 4.

Figure 4:
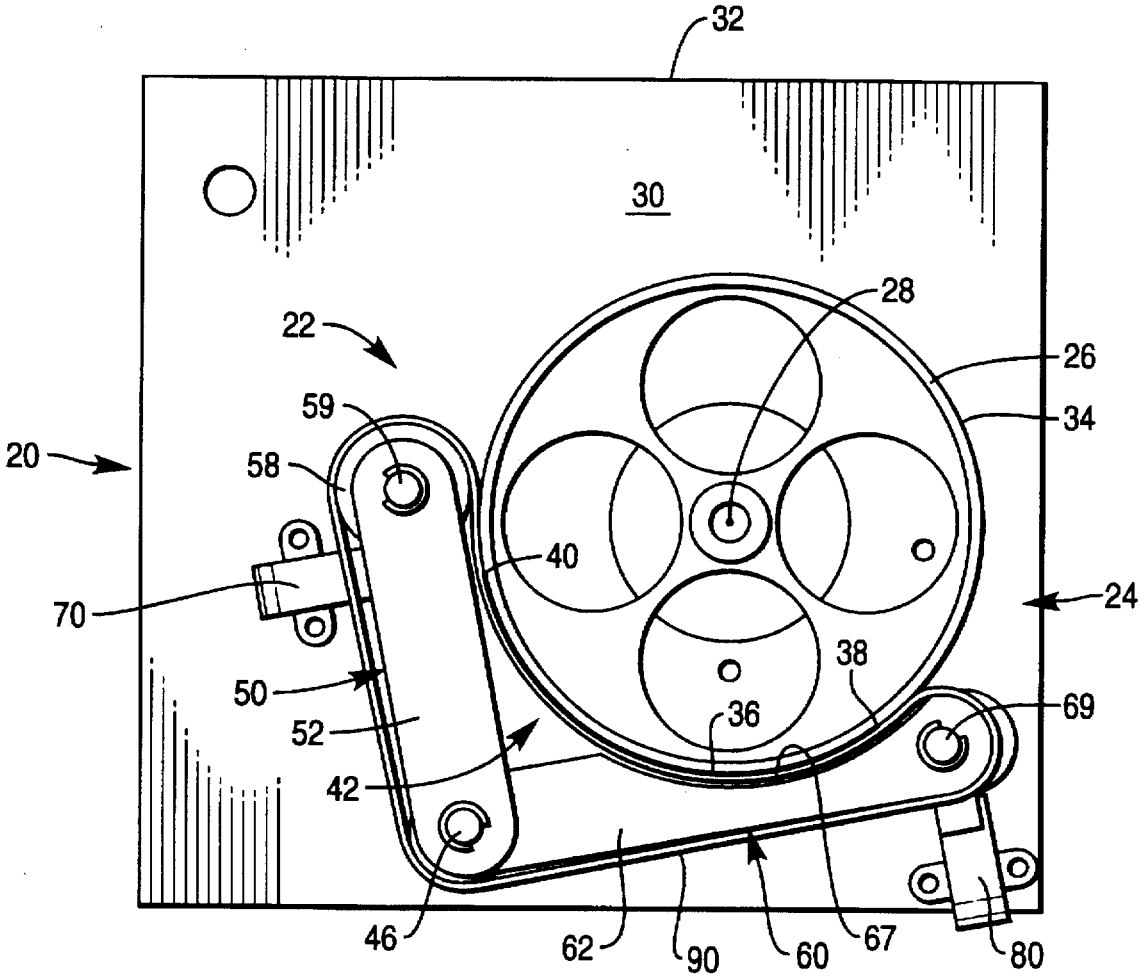
FIG. 4 is a view similar to FIG. 3 and showing the document in a different position along the document feeding line.
Figure 5:
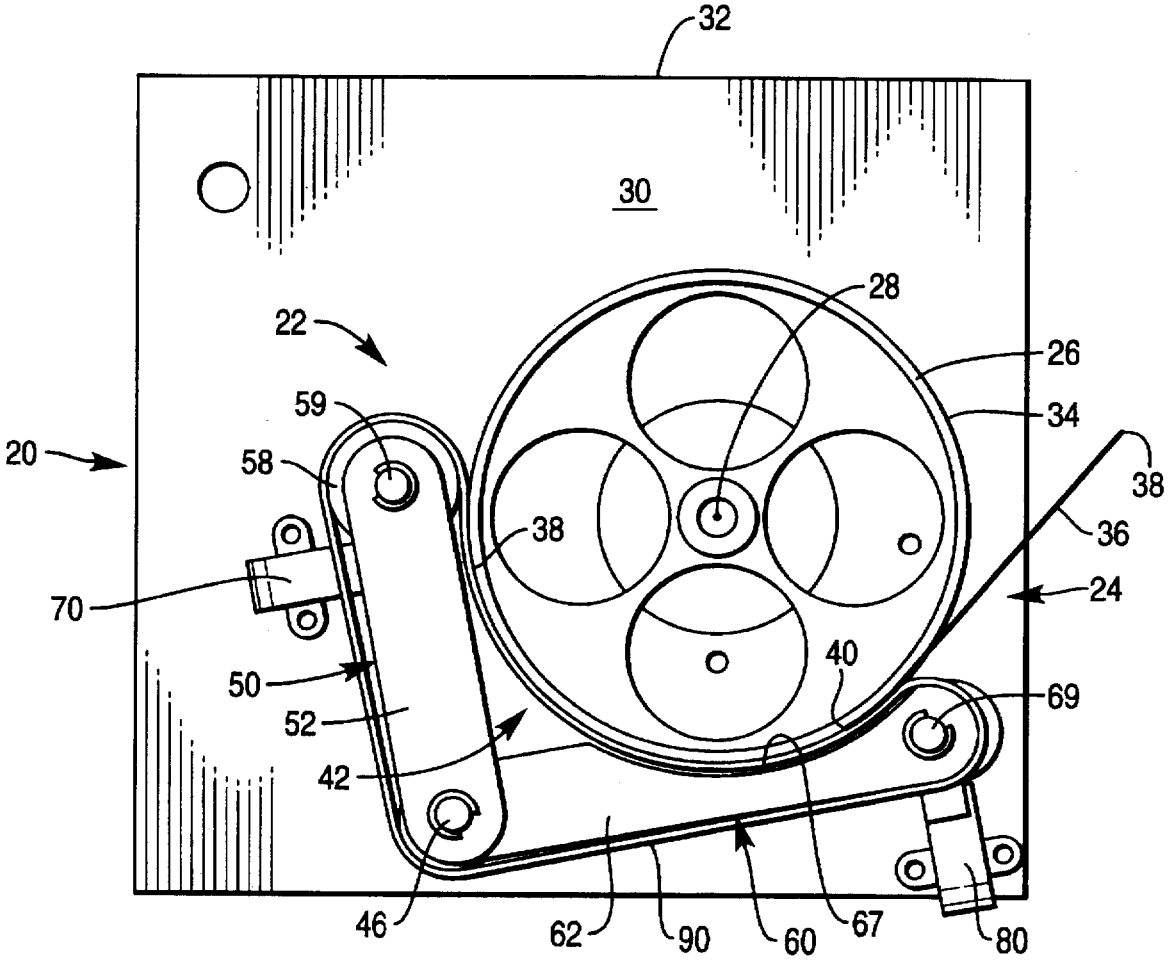
FIG. 5 is view similar to FIG. 4 and showing the document in another different position along the document feeding line.

The drive drum 26 continues to rotate and the belt 90 continues to move the document 36 from the intermediate position shown in FIG. 4 to a final position such as shown in FIG. 5. It should be apparent that as a result of the cooperation between the drive drum 26 and the belt 90, as described hereinabove, the document 36 is moved around the corner 42 (i.e., from the initial position shown in FIG. 3 to the final position shown in FIG. 5). It should be noted from FIGS. 3 and 5 that the corner 42 around which the document 36 has moved is greater than ninety degrees. The provision of the notch-shaped area 67 of the second arm assembly 60 has allowed the corner 42 to be greater than ninety degrees. The angle of the corner 42 depends upon the depth of the notch-shaped area 67 which is determined during manufacture of the second arm assembly 60.

Figure 6:
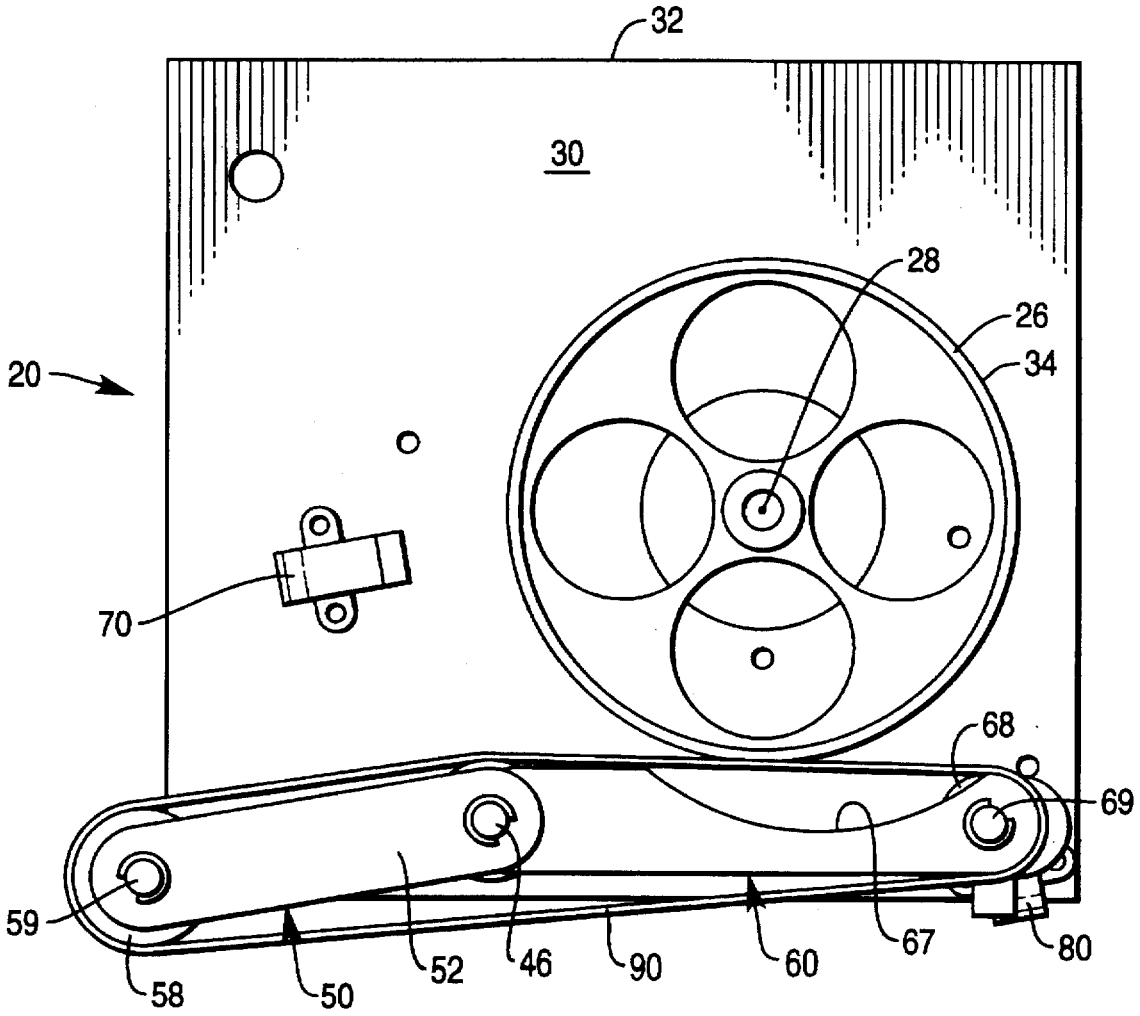
FIG. 6 is a view similar to FIG. 2 and showing parts in a different position.

An operable first snap mechanism 70 is located in the vicinity of the free end of the first arm assembly 50. When the first snap mechanism 70 is in the position as shown in FIGS. 1 and 2, the mechanism 70 acts to maintain the first arm assembly 50 in the locked position. When the first snap mechanism 70 is pressed downward (as viewed in FIG. 2), the first arm assembly 50 is released from the locked position shown in FIG. 2 and may be moved to an unlocked position such as shown in FIG. 6.

A operable second snap mechanism 80 is located in the vicinity of the free end of the second arm assembly 60. When the second snap mechanism 80 is in the position as shown in FIGS. 1 and 2, the mechanism 80 acts to maintain the second arm assembly 80 in the locked position. When the second snap mechanism 80 is pressed downward (as viewed in FIG. 2), the second arm assembly 60 is released from the locked position shown in FIG. 2 and may be moved to an unlocked position such as shown in FIG. 6. The pivot post 46 is located between the roller members 58, 68 of the first and second arm assemblies 50, 60 when the first and second arm assemblies 50, 60 are pivoted away from the outer circumferential surface 34 of the drive drum 26, as shown in FIG. 6.

It should be apparent that a certain amount of outer endless major side surface of the belt 90 presses against a certain amount of the outer circumferential surface 34 of the drive drum 26 when the either one of the arm assemblies 50, 60 is pivoted towards the outer circumferential surface 34 and less than the certain amount of the outer endless major side surface of the belt 90 presses against less than the certain amount of the outer circumferential surface 34 of the drum 26 when that particular arm assembly is pivoted away from the outer circumferential surface 34.

A number of advantages result by providing the document drive apparatus 20 in accordance with the present invention as described hereinabove. One advantage is that, if a document becomes jammed in the document drive apparatus 20, the jammed document can be easily removed by moving one or both of the first and second arm assemblies 50, 60 away from the outer circumferential surface 34 of the drive drum 26 in the manner as described hereinabove. Another advantage is that no springs or idlers are used to create the pinch force on the document 36. Instead, only the elasticity of the endless drive belt 90, when the endless drive belt 90 is deformed around the drive drum 26, is used to provide the pinch pressure on the document 36. The endless drive belt 90 has a smooth, consistent drive surface since the belt 90 has no edges of idlers or cutouts to hit as the belt 90 moves around the pivot roller 48 and the first and second rollers 58, 68.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A document drive apparatus having an upstream end, a downstream end, and a document feeding line defined between the ends and for directing a document having leading and trailing edges around a corner, the document drive apparatus comprising:

a base member having a mounting surface;

a drive drum having a longitudinal central axis and rotatably mounted on the mounting surface of the base member for rotation about its longitudinal central axis, the drive drum having an outer circumferential surface against which the document can be pressed;

an energizable motor coupled with the drive drum and for, when energized, rotating the drive drum about its longitudinal central axis;

a pivot post adjacent the outer circumferential surface of the drive drum and being non-releasably connected to the mounting surface of the base member;

a pivot roller having a longitudinal central axis and mounted on the pivot post for rotation about its longitudinal central axis, the pivot roller having an outer circumferential surface;

a first arm member having one end thereof connected to the pivot post;

a second arm member having one end thereof connected to the pivot post;

a first roller having a longitudinal central axis and mounted at the other end of the first arm member for rotation about its longitudinal central axis, the first roller having an outer circumferential surface;

a second roller having a longitudinal central axis and mounted at the other end of the second arm member for rotation about its longitudinal central axis, the second roller having an outer circumferential surface; and an endless drive belt having an outer endless major side surface and disposed on the outer circumferential surface of the pivot roller and the outer circumferential surfaces of the first and second rollers, the outer endless major side surface of the endless drive belt and the outer circumferential surface of the drive drum cooperating to define at least a portion of the document feeding line defined between the upstream and downstream ends of the drive apparatus;

at least one of the first and second arm members being pivotable about its end connected to the pivot post towards and away from the outer circumferential surface of the drive drum such that (i) a certain amount of the outer endless major side surface of the endless drive belt presses against the outer circumferential surface of the drive drum when the at least one arm member is pivoted towards the outer circumferential surface of the drive drum to enable the document to be directed around the corner, and (ii) less than the certain amount of the outer endless major side surface of the endless drive belt presses against the outer circumferential surface of the drive drum when the at least one arm member is pivoted away from the outer circumferential surface of the drive drum to enable a jammed document to be more easily removed from the document feeding line.

2. An apparatus according to claim 1, wherein the pivot post lies along a linear line extending between the first and second rollers when the at least one arm member is pivoted away from the outer circumferential surface of the drive drum.

3. An apparatus according to claim 1, wherein the first and second arm members form an L-shape about the pivot post when the at least one arm is pivoted towards the outer circumferential surface of the drive drum.

4. A document drive apparatus having an upstream end, a downstream end, and a document feeding line defined between the ends and for directing a document having leading and trailing edges around a corner, the document drive apparatus comprising:

a base member having a mounting surface;

a drive drum having a longitudinal central axis and rotatably mounted on the mounting surface of the base member for rotation about its longitudinal central axis, the drive drum having an outer circumferential surface against which the document can be pressed;

an energizable motor coupled with the drive drum and for, when energized, rotating the drive drum about its longitudinal central axis;

a pivot post adjacent the outer circumferential surface of the drive drum and fixedly mounted on the mounting surface of the base member;

a pivot roller having a longitudinal central axis and mounted on the pivot post for rotation about its longitudinal central axis, the pivot roller having an outer circumferential surface;

a first arm member having one end thereof connected to the pivot post;

a second arm member having one end thereof connected to the pivot post;

a first roller having a longitudinal central axis and mounted at the other end of the first arm member for rotation about its longitudinal central axis, the first roller having an outer circumferential surface;

a second roller having a longitudinal central axis and mounted at the other end of the second arm member for rotation about its longitudinal central axis, the second roller having an outer circumferential surface; and an endless drive belt having an outer endless major side surface and disposed on the outer circumferential surface of the pivot roller and the outer circumferential surfaces of the first and second rollers, the outer endless major side surface of the endless drive belt and the outer circumferential surface of the drive drum cooperating to define at least a portion of the document feeding line defined between the upstream and downstream ends of the drive apparatus;

at least one of the first and second arm members being pivotable about its end connected to the pivot post towards and away from the outer circumferential surface of the drive drum such that (i) a certain amount of the outer endless major side surface of the endless drive belt presses against the outer circumferential surface of the drive drum when the at least one arm member is pivoted towards the outer circumferential surface of the drive drum to enable the document to be directed around the corner, and (ii) less than the certain amount of the outer endless major side surface of the endless drive belt presses against the outer circumferential surface of the drive drum when the at least one arm member is pivoted away from the outer circumferential surface of the drive drum to enable a jammed document to be more easily removed from the document feeding line;

each of the first and second arm members being pivotable towards and away from the outer circumferential surface of the drive drum, one of the first and second arm members including surface means defining a notch-shaped area having a curvature which is complementary to the curvature of the outer circumferential surface of the drive drum.

5. An apparatus according to claim 4, further comprising a first snap mechanism located in the vicinity of the other end of the first arm member and for enabling the first arm member to be snapped into a locked position when the first arm member is pivoted towards the outer circumferential surface of the drive drum, the first snap mechanism being fixedly mounted on the mounting surface of the base member.

6. An apparatus according to claim 5, wherein the first snap mechanism is operable to allow the first arm member to be pivoted about the pivot post away from the locked position to an unlocked position away from the outer circumferential surface of the drive drum.

7. An apparatus according to claim 5, further comprising a second snap mechanism located in the vicinity of the other end of the second arm member and for enabling the second arm member to be snapped into a locked position when the second arm member is pivoted towards the outer circumferential surface of the drive drum, the second snap mechanism being fixedly mounted on the mounting surface of the base member.

8. An apparatus according to claim 7, wherein the second snap mechanism is operable to allow the second arm member to be pivoted about the pivot post away from the locked position to an unlocked position away from the outer circumferential surface of the drive drum.

* * * * *